US005873693A

United States Patent [19]

Suokas

[11] Patent Number: 5,873,693

[45] Date of Patent: Feb. 23, 1999

[54] PACKAGING APPARATUS FOR ARTICLE GOODS FED IN STACKS

[75] Inventor: Jouni Suokas, Tammela, Finland

[73] Assignee: Jomet Oy, Forssa, Finland

[21] Appl. No.: 747,211

[22] Filed: Nov. 12, 1996

[51] Int. Cl.[6] ..... B65G 59/00

[52] U.S. Cl. ..... 414/798.9; 414/798.7; 271/42

[58] Field of Search ..... 271/2, 42; 414/798.7, 414/798.9; 53/237, 245, 542

[56] References Cited

U.S. PATENT DOCUMENTS

| | | | |
|---|---|---|---|
| 3,040,488 | 6/1962 | Winkler et al. | 53/542 |
| 3,451,563 | 6/1969 | Luginbuhl | 414/798.9 |
| 3,462,917 | 8/1969 | Nakashima | 414/798.9 |
| 4,707,970 | 11/1987 | Labombarde et al. | 53/542 |
| 4,879,862 | 11/1989 | Nolte et al. . | |
| 4,884,675 | 12/1989 | Muraro et al. . | |
| 5,320,480 | 6/1994 | Tanaka | 414/798.9 |

FOREIGN PATENT DOCUMENTS

| | | | |
|---|---|---|---|
| 0111432 | 6/1984 | European Pat. Off. | 414/798.9 |
| 0 154 093 | 9/1985 | European Pat. Off. . | |
| WO 90/09315 | 8/1990 | WIPO . | |

*Primary Examiner*—Karen M. Young
*Assistant Examiner*—Douglas Hess
*Attorney, Agent, or Firm*—Pollock, Vande Sande & Priddy

[57] ABSTRACT

An apparatus for packaging article goods fed in a stack comprises a feeding table for introducing the goods with the individual articles in an upright position in the form of a continuous stack, the table defining a feeding path for the stack, an aftertreatment unit for receiving the goods from the table and a grouping device provided on the table and including a pusher for moving a batch of a predetermined size aside form the rest of the continuous stack to the aftertreatment unit. The grouping device is arranged in a frame movable in a vertical direction to an upper position above the table to leave the table free for manual handling. The apparatus further comprises releasable locking members for securing the movable frame in the upper position.

7 Claims, 6 Drawing Sheets

PACKAGING APPARATUS FOR ARTICLE GOODS FED IN STACKS

FIELD OF INVENTION

The present invention relates to an apparatus for packaging article goods fed in stacks.

BACKGROUND OF THE INVENTION

Machines for packaging article goods, especially envelope packaging machines have a feeding table, onto which the goods to be packaged are introduced one after the other by means of a conveyor. The conveyor pushes continuously the articles in a form of a stack forwardly to the table in such a way that they are in approximately upright position with their lower edges against the table surface. For automatic grouping and packaging of goods of this kind, batches of certain size are separated from the front end of the advancing stack by means of special separating means. These batches are pushed aside by a pusher to an aftertreatment unit that is located adjacent to the table. An automatically operated apparatus of this kind is known, for example, from a co-pending U.S. patent application Ser. No. 08/682,718 "Apparatus for separating a stack portion with a separator element and a device for gripping a protruding marker" filed on Jul. 29, 1996 and based on International Application No. PCT/FI95/00032. This application is assigned to the Assignee of the present invention and it is incorporated herein by reference. The problem with automatic apparatuses is that they are not suitable for manual packaging. In order to perform manual packaging, either the pushing device comprising the separating means and the pusher itself has to be demounted, or another manual line has to be provided in addition to the automatic one. U.S. Pat. No. 4,884,675 shows a grouping device receiving letter envelopes directly from an envelope production machine. The grouping device is pivotable in a horizontal direction away from a position above the table to a position where it allows free access to the table for manual operation. However, in the apparatus there is often need for several operations at the usual working height of approximately 0.6 to 1.1 m. The horizontally pivotable construction requires space in the packaging apparatus, which needs several accessories which must be placed at a suitable height to be accessible for example for maintenance and adjustments.

SUMMARY OF THE INVENTION

It is therefore an object of the present invention to eliminate the drawbacks mentioned above and to provide an apparatus which allows to carry out either manual or automatic preliminary handling of the articles on the table level. In order to achieve this purpose the apparatus according to the invention is characterized by a separate frame incorporating the pusher together with its actuators and being movable vertically up and down in relation to a stationary aftertreatment unit situated along one side of the movable frame. The frame can be secured in an upper position where it is not in the way during manual operations on the table level.

It is possible to shift from an automatic operation to manual a operation by lifting the frame and it can be quickly lowered to its lower position if automatic operation is again desired. The apparatus is especially suitable for those production and packaging lines where there is often the need to manually package small series of goods.

DETAILED DESCRIPTION OF THE INVENTION PREFERRED EMBODIMENTS

Figure 1:
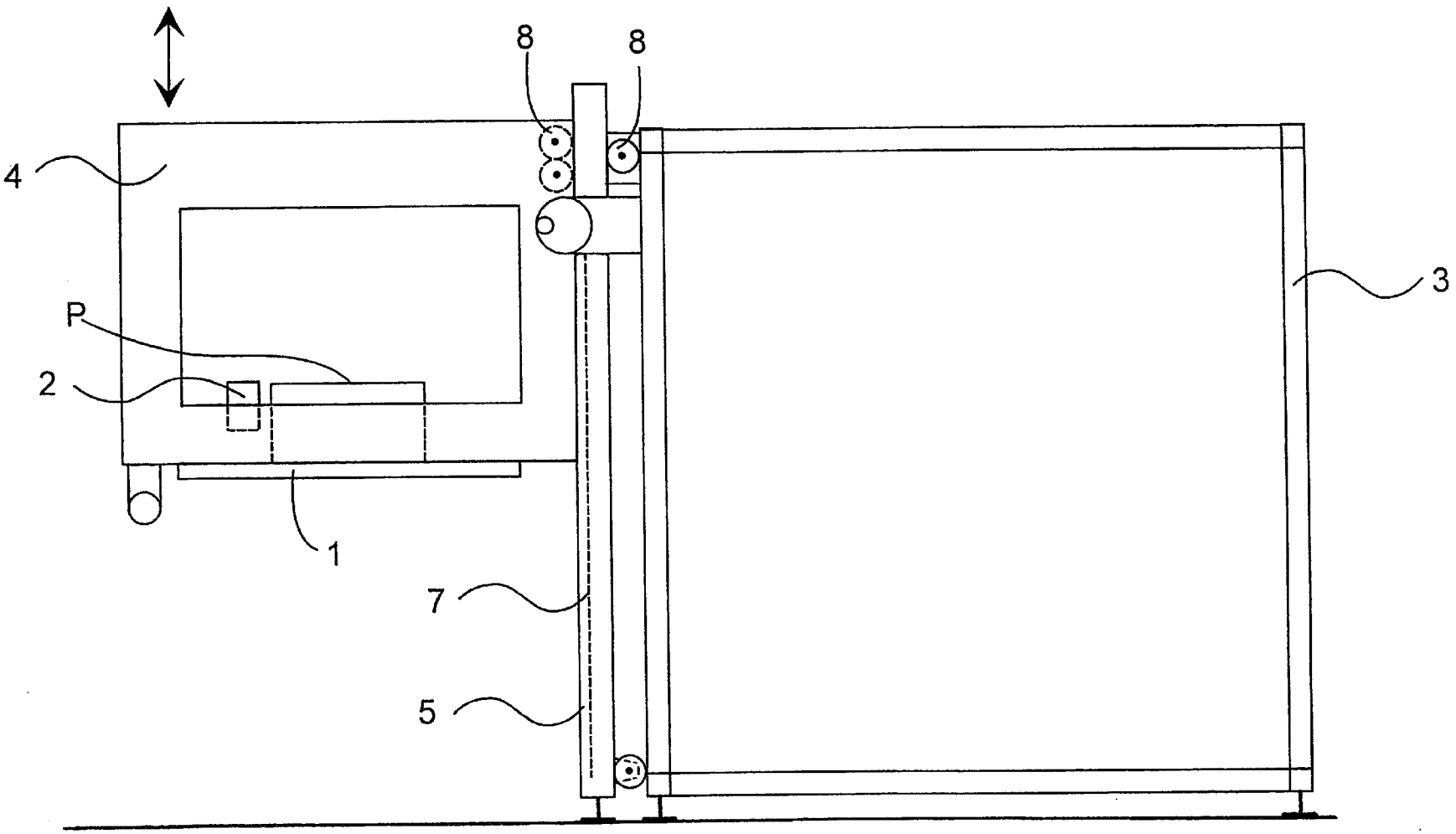
FIG. 1 is a front view of the apparatus opposite to the introducing direction of the stack.
Figure 2:
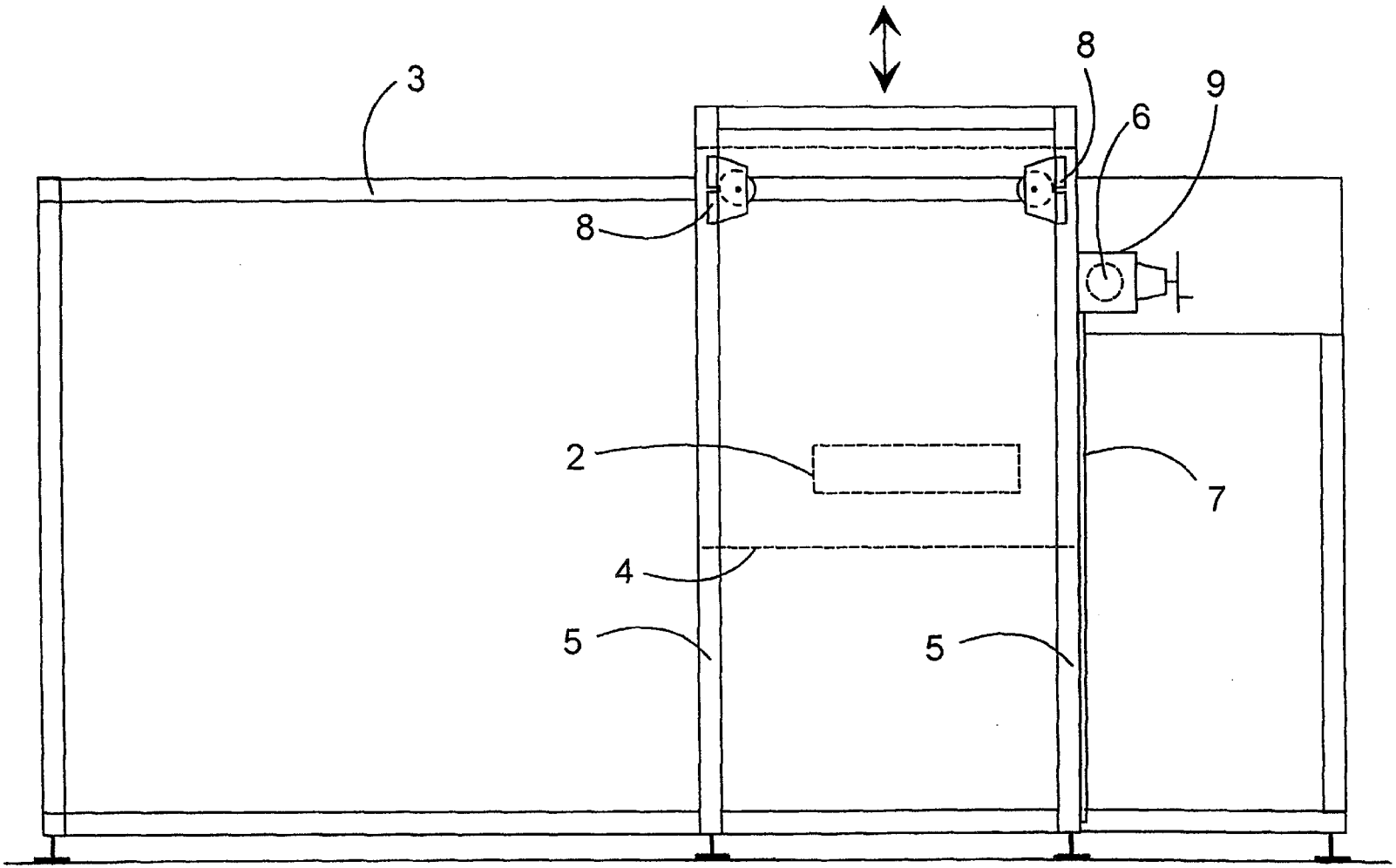
FIG. 2 is a side view of the apparatus.

In FIGS. 1 and 2 the apparatus is shown in a position where it is feeding a continuous stack P onto a table, most commonly paper goods, in most cases letter envelopes. As the stack is moving forwards along a feeding path determined by the conveyor on the table, known also as "separation table", and the goods are held in an upright position with the help of a moving stopper from the front, they get into the range of action of a pusher 2, which is movable back and forth above the table 1 and positioned so, it during its forward stroke it pushes a batch of predetermined size, separated from the stack, to the opposite side of the stack feeding path into an aftertreatment unit. In the aftertreatment unit the batch is handled further for bringing it finally into a container, such as a carton. This aftertreatment can comprise several steps, such as moving the batch further and forming a final package from the batch and the packaging material. Various alternatives for performing these steps are available, and since they are well known in the art, they are not described in more detail here. In the grouping device, in addition to the pusher 2 and its actuators, also separating means, which determine the length of the batch that is to be pushed aside with the pusher 2. The way of operation of the separating means is also known as such, and there are several alternatives available for this operational step.

The pusher 2 and the actuators effecting its reciprocating movement, as well as the separating means located before the pusher 2 in the feeding direction of the stack are all mounted in a common frame 4. The frame is positioned at such a height with respect to the table the pusher 2 can perform its reciprocating movement for pushing each batch separated at the front end of the stack by means of its forward stroke substantially parallelly to the table level. Some frame parts can lie against the table surface, approximately at the height of 0.6 to 1.1 m.

Figure 3:
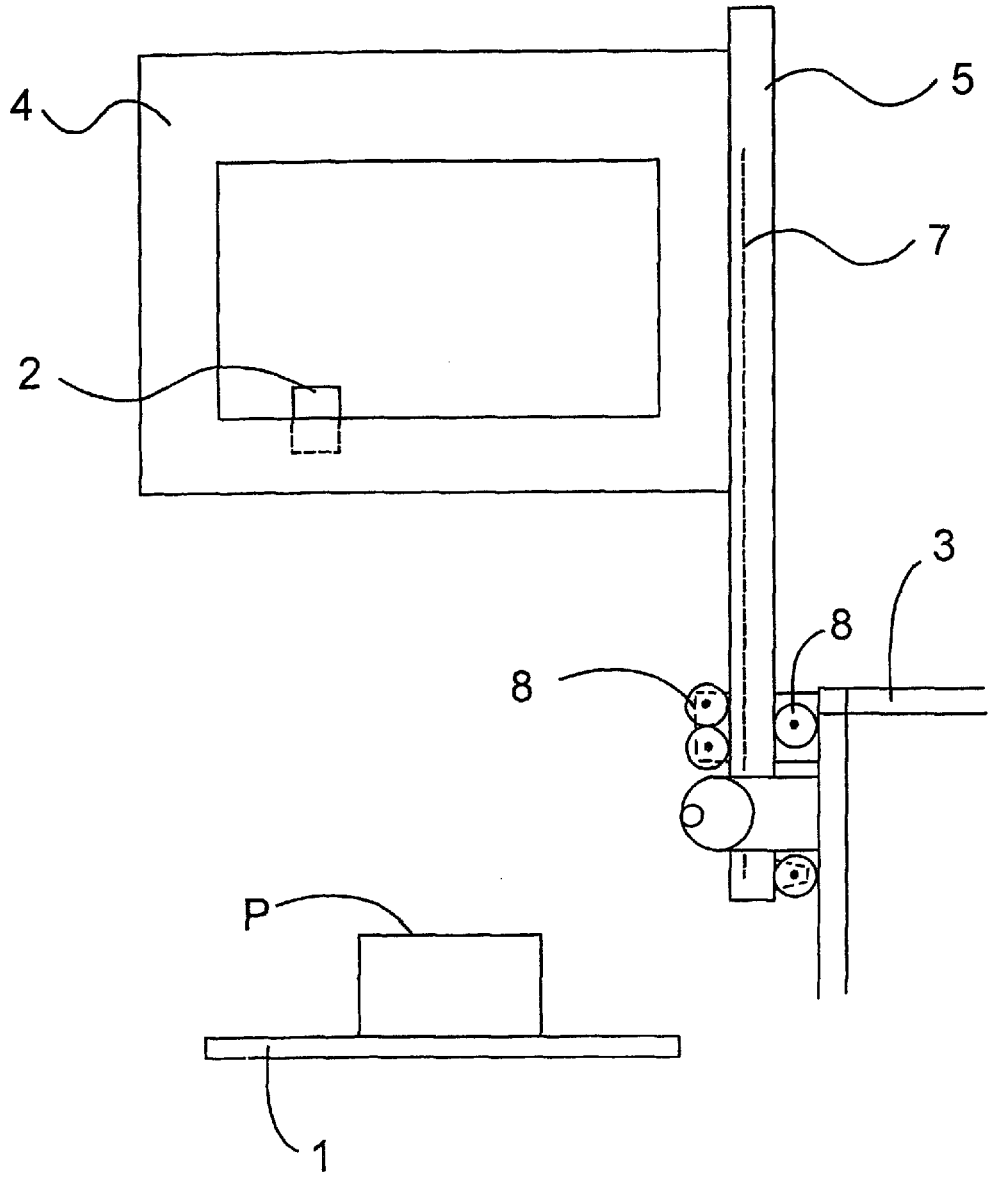
FIG. 3 shows the frame in the upper position.

The frame 4 is movable in a vertical direction with respect to the table 1 in such a manner that it can be lifted to an upper position, in which it leaves the table level and a certain height above it free for manual operation. The height is preferably such, that a person can easily perform manual operations at the table, and the lowest parts of the frame that are on or above the table should be liftable at least to a height of 1.8 m from the floor, preferably at least to a height of 2.0 m. This situation is illustrated in FIG. 3, in which it can be seen a vertical guide 5 in the frame 4 provided for a movement up and down and supported by the stationary frame of the apparatus, in this case by the frame 3 of the aftertreatment unit. It is also possible to use mechanisms of other types in the apparatus making it possible to lift the separate frame 4 or "pusher frame" to the desired height. The is common feature of all these mechanisms is that they lift the frame 4 right up away from the table, and the mechanism can be, for example, of the articulated jack type that is mounted on the frame 3 of the aftertreatment unit and movable up and down with respect to the aftertreatment unit.

In the following, the embodiment of the transfer mechanism of the separate frame 4 will be described in more detail.

As is shown in FIGS. 1 to 3, the frame, 4 of the grouping device is mounted on the frame 3 of the aftertreatment unit movable by an actuator attached to the frame 3 of the aftertreatment unit and acting between the two frames. For moving the frame 4 in a vertical direction it is provided with two vertical guides 5 spaced horizontally from each other and being supported by their lower ends on the floor. The guides 5 extend vertically between the far side of the table 1 as seen from the pusher and the frame 3 of the aftertreatment unit. The rest of the frame 4 lying on or above the table 1 is attached on longitudinal vertical sides of these elongate guides 5. A tooth-wheel 6 is mounted on the frame 3 of the aftertreatment unit and it can be rotated by means of a crank. The tooth-wheel 6 engages a toothed bar or rack bar 7 shown schematically in FIG. 3 by broken line along one of the elongate guides 5.

The vertical upward movement of both guides is supported by support rollers 8 from both sides of each guide, the rollers being mounted freely rotatably on the frame 3 of the aftertreatment unit to lie against the guide from the side of the table 1 and from the side of the aftertreatment unit, respectively. By manually actuating the crank the tooth-wheel 6 can be rotated, and a suitable transmission ratio is achieved for example by means of a gearing 9 between the crank or some other type of handle and the tooth-wheel. After the frame 4 has been lifted to its upper position, a locking member 10 situated in the frame 3 of the aftertreatment unit is used. The member 10 can in principle be of any locking element that is moved into a corresponding receiving part in the frame 6. The locking member can, for example, be a tongue or a pin that is pushed laterally or pivoted into a recess or notch arranged on the side surface of the vertical guide 5. Also other types of co-operating locking elements can be provided in the frame 4 and frame 3, respectively.

Figure 4:
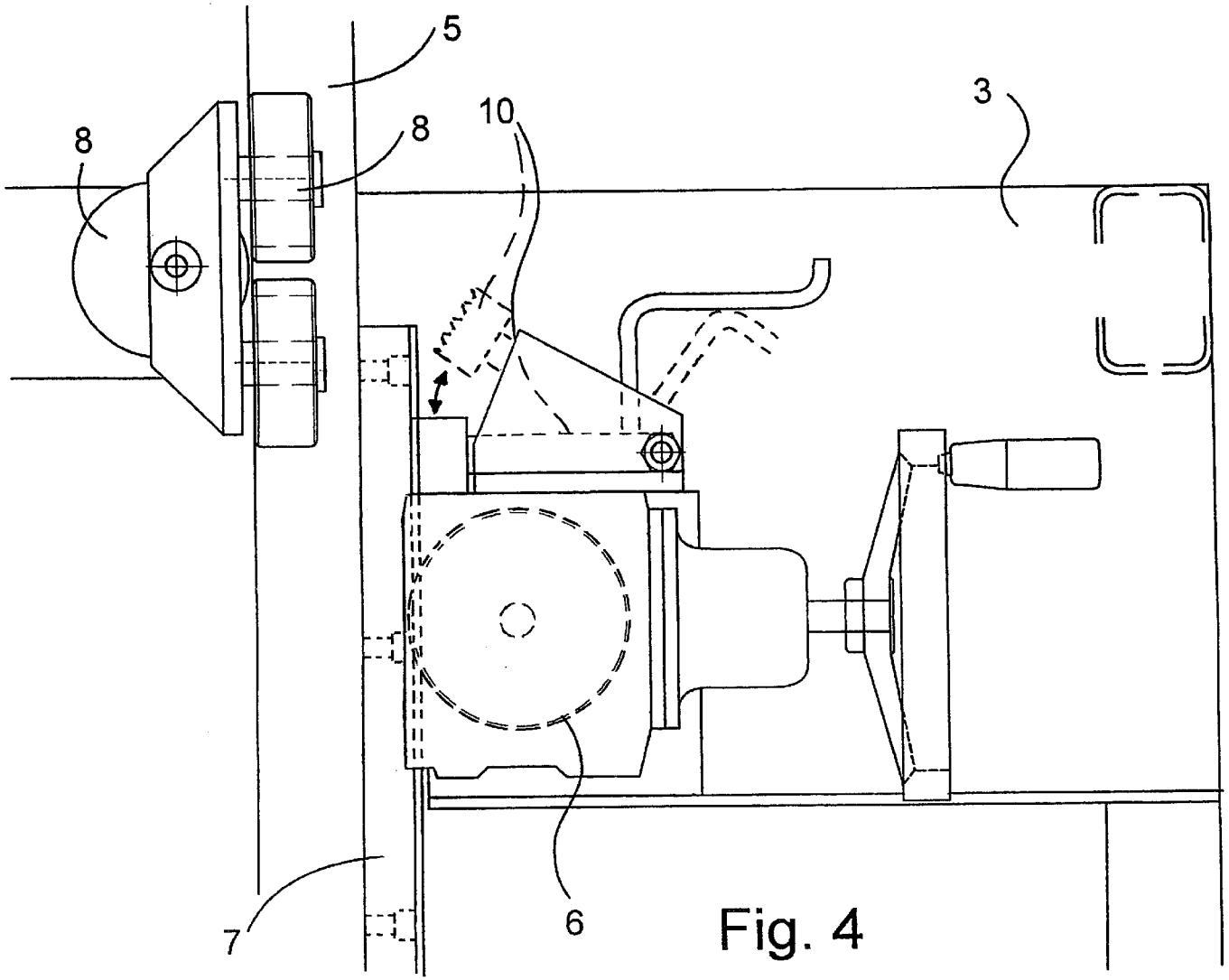
FIG. 4 shows the transfer mechanism in a larger scale.
Figure 5:
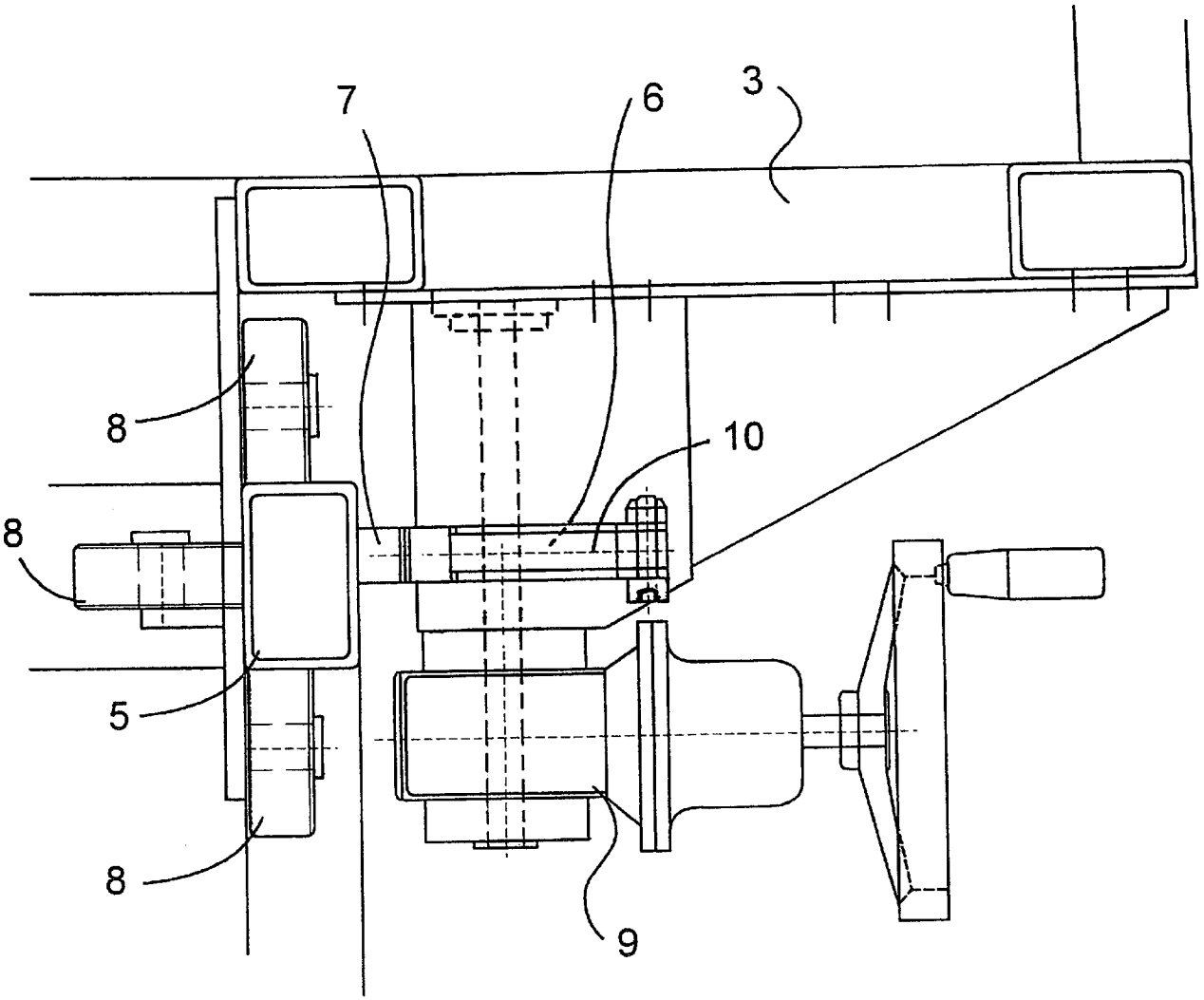
FIG. 5 is a top plan view of the transfer mechanism.

FIG. 4 shows an advantageous embodiment of an automatic stepless system where the locking member 10 is an elongate piece pivotable in a vertical direction between two upright support plates and having a limited pivotal movement in a downward direction. The piece is provided at its free end facing the toothed rod with a corresponding toothing so that it can, in its lowermost position, come into engagement with the toothed bar 7 and prevent the entire frame 4 from sliding downwards. When the frame 4 is to be lifted, the locking member will not be in the way, because it will be lifted upwards by the effect of the continuous upward movement of the toothed bar, and only a downward movement will cause the locking member to fall back to its locking position. In case the frame 4 is to be lowered again, the locking member is held continuously in the lifted position by keeping hold of the handle of the locking member 10.

Figure 6:
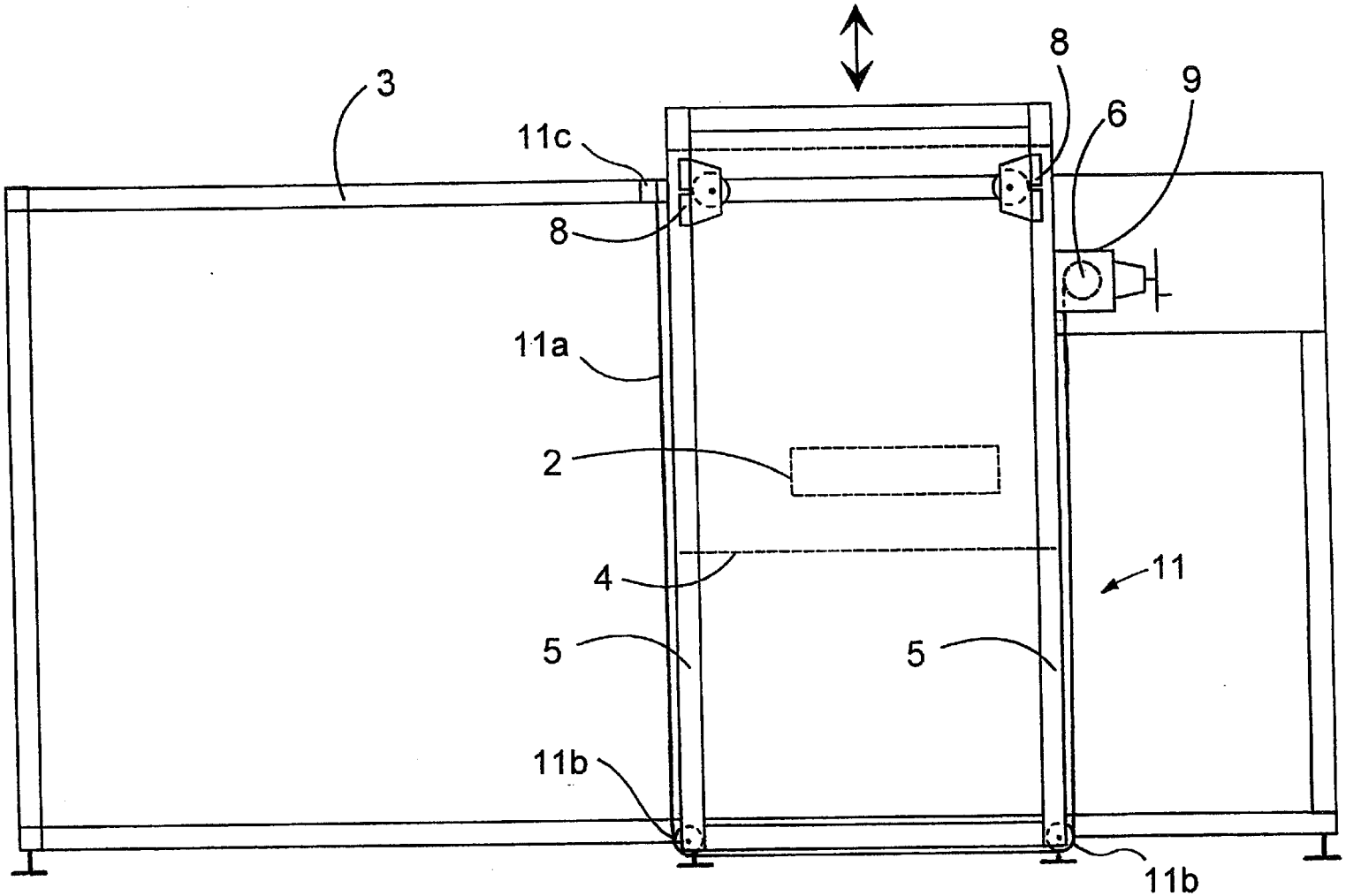
FIG. 6 shows one alternative embodiment of the transfer mechanism.

FIG. 6 shows another embodiment of the transfer mechanism, which is a traction mechanism 11. An elongate flexible traction element 11*a*, such as a draw line, is wound on a wheel 6 that can be actuated in the same manner as the tooth-wheel 6 of the preceding embodiment. The element 11*a* is guided around two guide rolls 11*b* at the lower corners of the frame 4 and at its opposite end it is attached to a holder 11*c* in an upper part of the stationary frame 3. In the preceding embodiment the toothed bar 7 served both as one part of the transfer mechanism and the receiving part for the locking member 10, whereas in this embodiment the toothed bar (not shown) is provided only for locking.

It is intended that the frame 4 can be manually lifted easily and quickly only by one person. The manual actuator, such as the co-acting elements tooth-wheel toothed bar, can be provided with sufficient friction so that the frame 4 can not suddenly rush down from its upper position even if it is unattended and the lock does not operate, but in this case would only slide gently down without causing any risk to personnel or equipment.

Instead of manual lifting operation, the lifting can be effected also with external force, for example by means of an electrical motor, and the basic principle of the mechanism can be the same also in this case. Further, the movement can be effected by means of an actuator variable in length, such as work cylinders driven by a pressurized medium, preferably pneumatic cylinders, or by means of a rotatable screw rod which is in engagement with a part gliding therealong. The rotation of this rod can be effected by means of a motor, or if manual face is used, it can be rotated by hand through a suitable transmission mechanism. Whatever the mechanism or its driving power is, these actuators have always two parts movable with respect to each other, whereof one is attached to the frame 3 of the aftertreatment unit and the other to the frame 4 of the grouping device. One part of the actuator can be mounted in a suitable place in the frame 4 of the grouping device, and not necessarily in the guide 5, whose main purpose is to guide the movement of the frame 4 up and down and to be supported by other frame parts of the whole apparatus.

What is claimed is:

1. An apparatus for packaging article goods fed in a stack, the apparatus comprising a stationary feeding table for introducing the goods with the individual articles in upright position in the form of a continuous stack, the table defining a horizontal feeding path for the continuous stack, an aftertreatment unit for receiving the goods from the feeding table, a grouping device provided on the table in a position for automatic operation and including a pusher for moving a batch of a predetermined size aside from the rest of the continuous stack to said aftertreatment unit, said grouping device together with said pusher being arranged in a frame movable in a vertical direction with respect to the table, to an upper inactive position of the grouping device above the position for automatic operation of the grouping device above the table, and releasable locking means for securing said movable frame in said upper inactive position.

2. An apparatus as claimed in claim 1, wherein the movable frame is movable by an actuator mounted on a frame of the aftertreatment unit.

3. An apparatus as claimed in claim 1, wherein said movable frame comprises at least one vertical guide placed movably along a frame of the aftertreatment unit.

4. An apparatus as claimed in claim 3, comprising at least two vertical guides spaced apart from each other in the direction of said feeding path of the stack and situated between an outer edge of the feeding table and the frame of the aftertreatment unit.

5. An apparatus as claimed in claim 1, wherein the releasable locking means comprises a locking member mounted in a stationary structure of the apparatus and pivotable upwardly from a rest position where its downward movement is prevented, said member being equipped at its free end with at least one protrusion adapted to be engaged by at least one corresponding recess provided on the movable frame and facing said free end of the locking member.

6. An apparatus as claimed in claim 5, wherein several recesses are provided spaced apart along a vertical structure on the movable frame.

7. An apparatus according to claim 5, wherein said stationary structure is a frame of said aftertreatment unit.

* * * * *